United States Patent [19]

Evensen

[11] Patent Number: 5,007,473

[45] Date of Patent: Apr. 16, 1991

[54] PORTABLE PARTITION SYSTEM

[75] Inventor: David P. Evensen, Wheeling, Ill.

[73] Assignee: Nimlock Company, Niles, Ill.

[21] Appl. No.: 569,511

[22] Filed: Aug. 20, 1990

Related U.S. Application Data

[63] Continuation of application Ser. No. 388,662 filed Aug. 2, 1989 abandoned.

[51] Int. Cl.[5] ..... A47G 5/00

[52] U.S. Cl. ..... 160/135; 160/351; 52/239

[58] Field of Search ..... 160/135, 351, 229.1, 160/381; 52/239, DIG. 13

[56] References Cited

U.S. PATENT DOCUMENTS

| | | | |
|---|---|---|---|
| 3,592,289 | 7/1971 | Aysta et al. | 160/381 X |
| 4,028,855 | 6/1977 | Prewer | 52/DIG. 13 X |
| 4,047,337 | 9/1977 | Bergstrom | 160/135 X |
| 4,068,700 | 1/1978 | Legler | 160/381 X |
| 4,129,163 | 12/1978 | Johnson | 52/239 X |
| 4,491,166 | 1/1985 | Hanna | 52/DIG. 13 X |
| 4,593,508 | 6/1986 | Curatolo | 52/239 |
| 4,635,418 | 1/1987 | Hobgood | 52/DIG. 13 X |
| 4,722,146 | 2/1988 | Kemeny | 52/DIG. 13 X |
| 4,825,930 | 5/1989 | Lindberg et al. | 160/135 |
| 4,836,787 | 6/1989 | Boo | 52/DIG. 13 X |

*Primary Examiner*—David M. Purol

*Attorney, Agent, or Firm*—Neuman, Williams, Anderson & Olson

[57] ABSTRACT

A portable partition system is provided having a pair of panel components which are adapted to assume either an operative or inoperative mode. First segments of the peripheral edges of the panel components are provided with a first attaching element and second segments thereof are provided with a compatible second attaching element whereby, when the first attaching element of one panel component and the compatible second attaching element of the other panel component are pushed together, the panel components are interconnected in an operative mode and can be adjusted to any selected relative angular position. The interconnected panel components can be disconnected from one another upon a predetermined pulling force being exerted on one of the components. The disconnected components, when in an inoperative mode, are adapted to assume a stacked face to face relation.

4 Claims, 3 Drawing Sheets

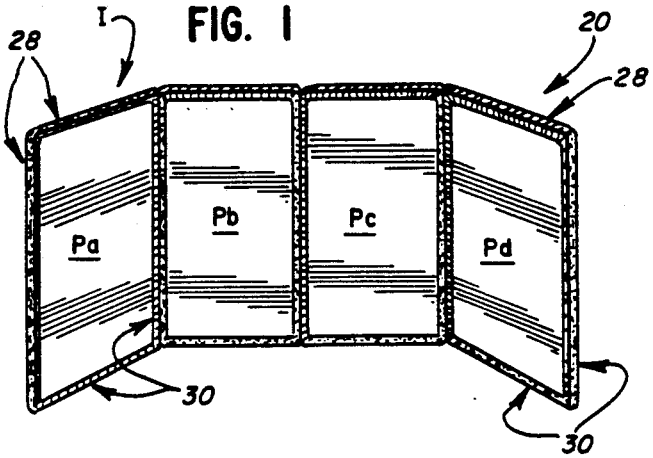
FIG. 1
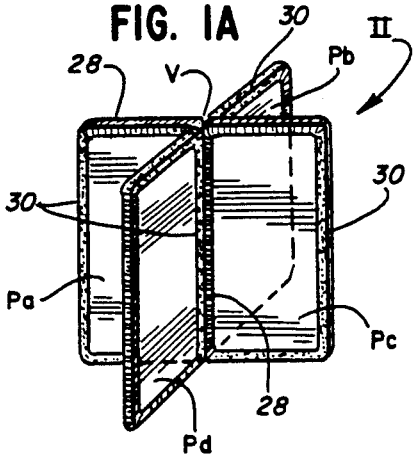
FIG. 1A
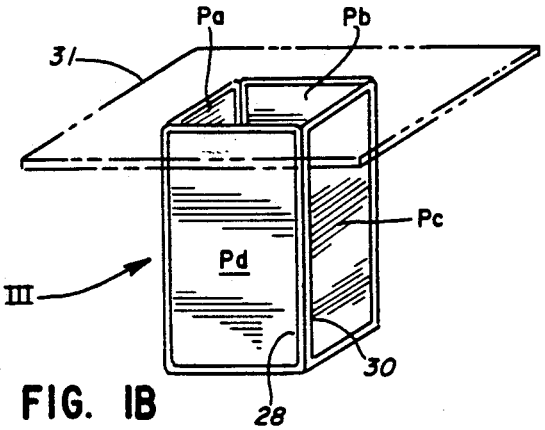
FIG. 1B
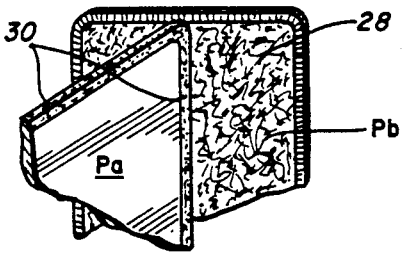
FIG. 1C
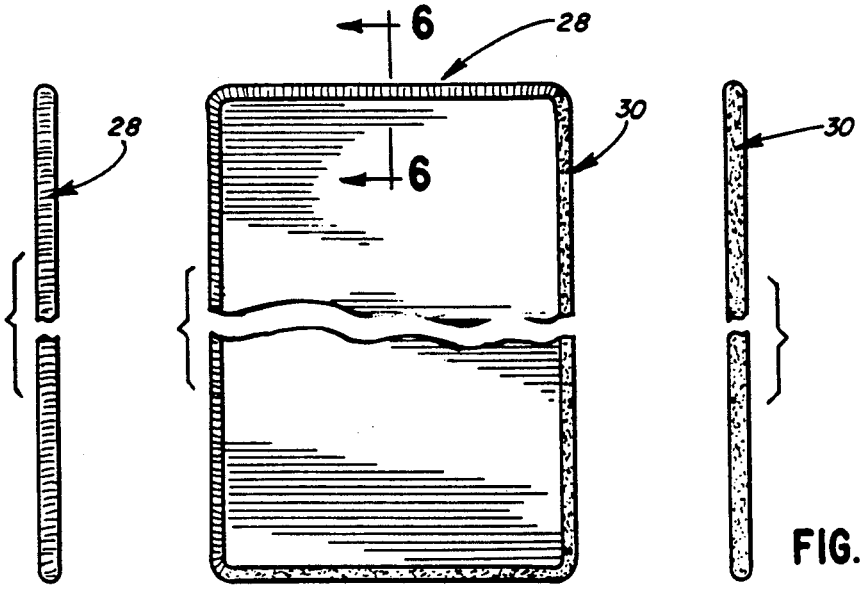
FIG. 4
FIG. 3
FIG. 2

FIG. 5
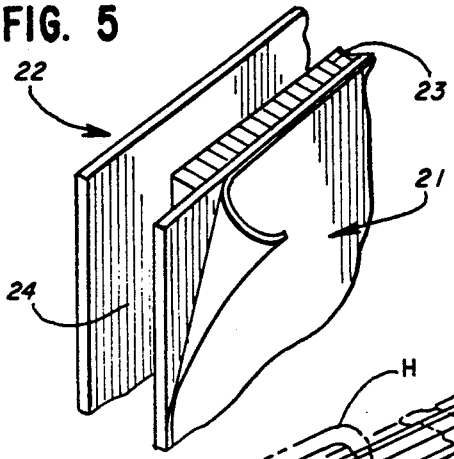
FIG. 6
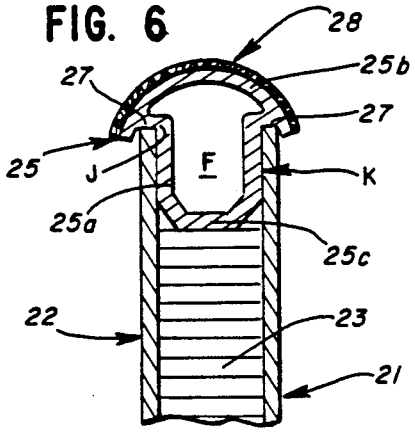
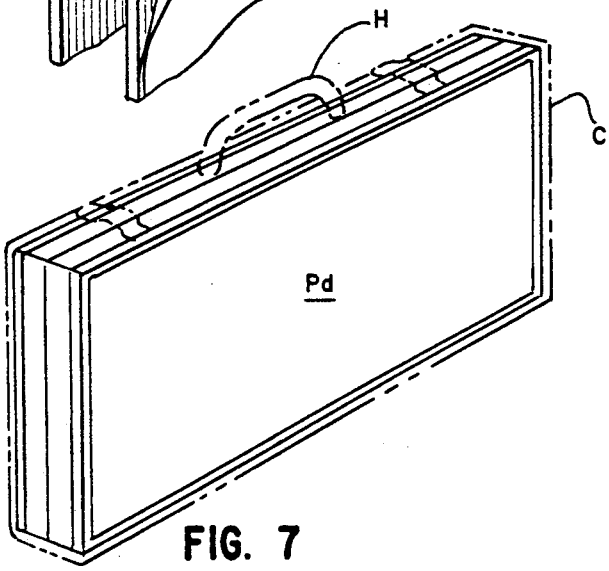
FIG. 7
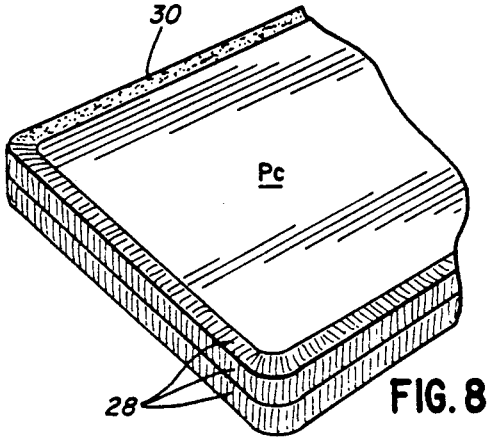
FIG. 8
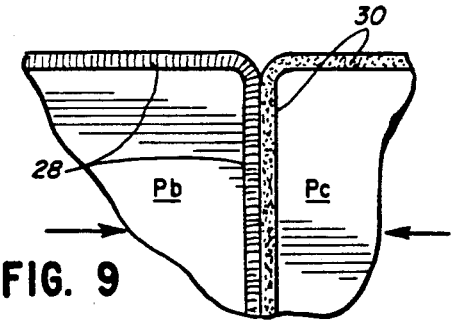
FIG. 9
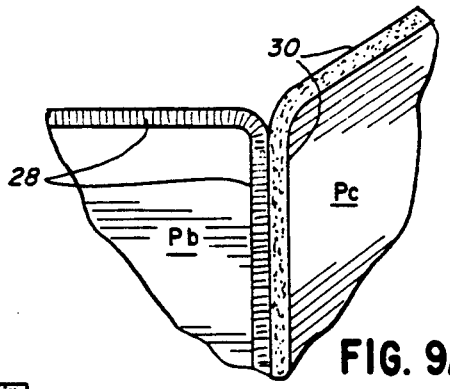
FIG. 9A
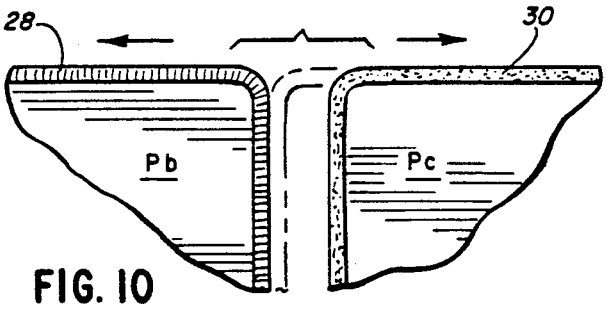
FIG. 10

PORTABLE PARTITION SYSTEM

CROSS REFERENCE TO RELATED APPLICATIONS

This is a continuation of application Ser. No. 07/388,662, filed Aug. 2, 1989 and now abandoned, the text of which is hereby incorporated by reference.

BACKGROUND OF THE INVENTION

Various portable partition systems for use in setting up booths and various displays at conventions, tradeshows, retail stores and the like have heretofore been widely utilized. Such prior systems, however, are beset with one or more of the following shortcomings: (a) the system is difficult and awkward to setup and disassemble and requires the services of one or more skilled erectors; (b) the system includes an inordinate number of component parts; (c) to setup or disassemble the system requires special tools; (d) the components of the system are heavy, bulky and of costly, complex design; (e) the system is not readily adapted to be setup to assume a variety of esthetic structural forms; (f) the components of the system, when in a disassembled state, cannot assume a portable compact unit suitable for storage and manual transport; (g) the number, size and relative location of the system components cannot be readily changed; and (h) the system requires a variety of fasteners and/or clips which may be readily lost or misplaced.

SUMMARY OF THE INVENTION

Thus, an improved portable partition system has been provided which readily avoids all of the aforenoted shortcomings associated with various prior systems of this general type.

It is a further object to provide an improved partition system wherein the components thereof may vary in size and shape over a wide range.

It is a further object to provide an improved partition system which has a minimum number of components and may be readily setup and disassembled by a single person.

It is a still further object to provide an improved partition system which forms a stable, attractive and utilitarian structure.

It is a still further object to provide an improved partition system which may be dimensioned so as to form an educational, toylike system for children which would enable them to develop their artistic and fine motor skills in creating various structures.

Another object is to provide an improved partition system wherein the panels thereof may have surface areas of contrasting and/or coordinated colors and/or textures thereby producing structures having an esthetic appeal which varies over a wide range.

Further and additional objects will appear from the description, accompanying drawings, and appended claims.

In accordance with one embodiment of the invention, a portable partition system is provided having a plurality of panels which are adapted to assume either an operative or inoperative mode. Each panel is provided with a first attaching means which is mounted on a selected peripheral segment of the panel. A second attaching means is provided which is separate from the first attaching means and is mounted on an exterior portion of the panel. When the panels are in the operative mode, the first attaching means of the one panel is initially pressed against the second attaching means of a second panel whereby the attaching means interlock yet allow the panels to be adjusted to any selected relative angular position. To disassemble the interlocked panels, requires only a predetermined external pulling force being applied to one of the panels causing the attaching means of one panel to disengage from the attaching means of the other panel. The individual panels are then arranged in stacked face to face or superposed relation thereby assuming one inoperative mode. When the panels are in the inoperative mode, they form a compact unit suitable for storage or manual transport.

DESCRIPTION OF THE INVENTION

For a more complete understanding of the invention reference should be made to the drawings wherein FIGS. 1, 1*a* and 1*b* are perspective views of one embodiment of the improved partition system shown in an operative mode and setup to form various structures.

FIG. 1*c* is a fragmentary perspective showing a pair of panels of the improved partition system interconnected in a T formation.

FIG. 2 is a fragmentary front elevational view of a panel shown in FIG. 1.

FIGS. 3 and 4 are right and left side elevational views, respectively, of the panel of FIG. 2.

FIG. 5 is an enlarged fragmentary perspective corner view of the panel of FIG. 2 with the attaching means thereof removed.

FIG. 6 is an enlarged sectional views taken along line 6—6 of FIG. 2.

FIG. 7 is a perspective view of the partition system of FIG. 1 shown in an inoperative mode with the panels thereof accommodated in a suitable carrying case, the latter being shown in phantom lines.

FIG. 8 is an enlarged fragmentary perspective view showing certain panels of the partition system of FIG. 1 arranged in stacked face to face relation.

FIG. 9 is an enlarged, fragmentary, elevational view of the center pair of panels of FIG. 1 assembled in an abutting, substantially coplanar relation.

FIG. 9*a* similar to FIG. 9 but showing the assembled panels in an angular relation.

FIG. 10 is similar to FIG. 9 but showing the panels in a disassembled relation.

Figure 11:
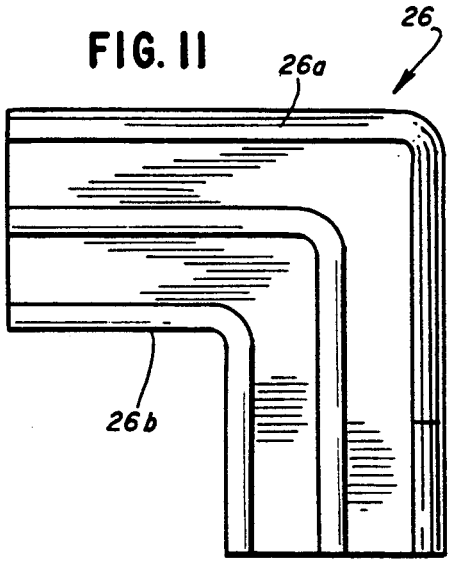

FIG. 11 is an enlarged front view of one embodiment of a corner connecting piece for the panels of FIG. 5.

Figure 12:
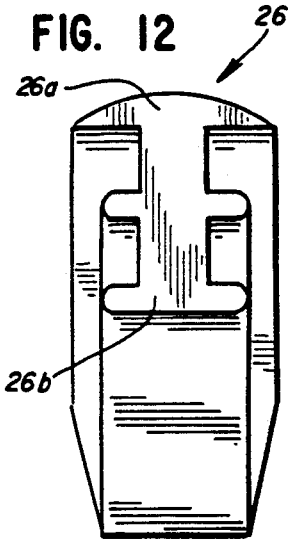
Figure 13:
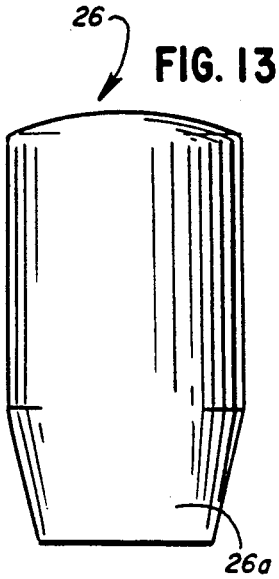

FIGS. 12 and 13 are left and right side elevational views, respectively, of the connecting piece of FIG. 11.

Figure 14:
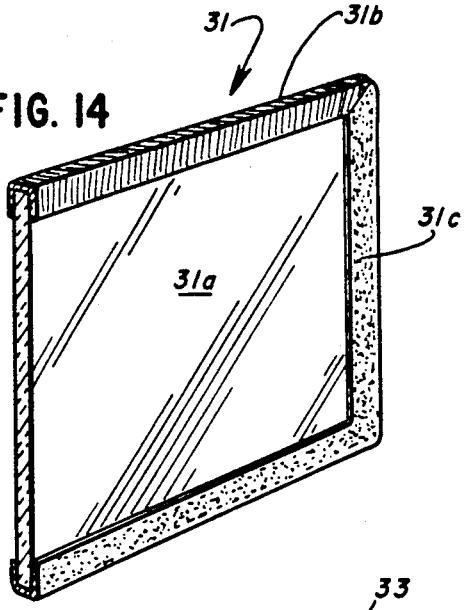

FIG. 14 is an enlarged vertical sectional view of a panel which is dimensioned for use as a component in an educational toylike system.

Figure 15:
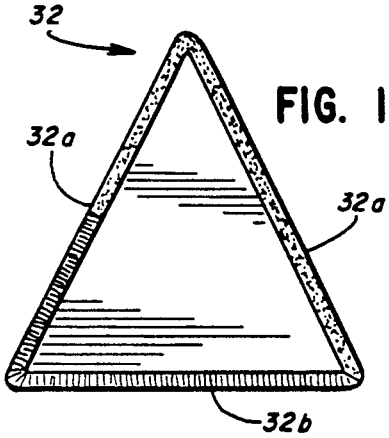
Figure 16:
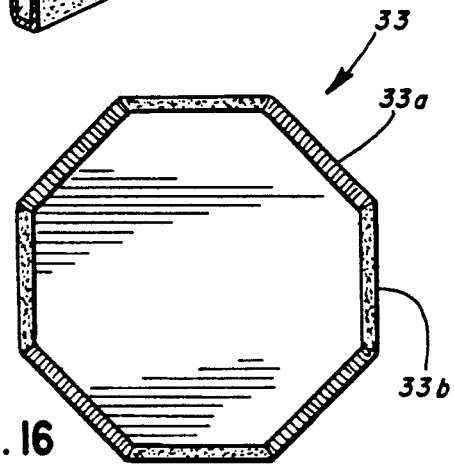
Figure 17:
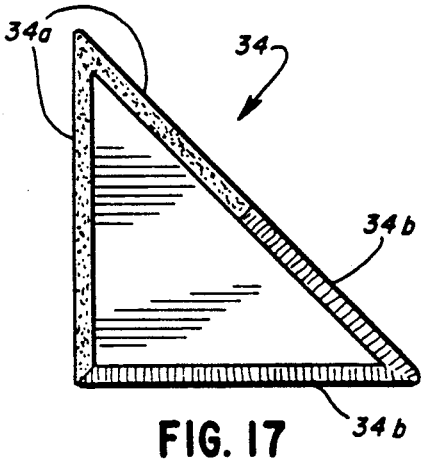

FIGS. 15–17 are front elevational views of various shape panels which may be components of the improved system.

Referring now to the drawings and more particularly to FIG. 1, one embodiment 20 of the improved partition system is shown in an operative mode and forming a partition or boothlike structure I, as will be described more fully hereinafter. System embodiment 20, as illustrated, includes four panels Pa, Pb, Pc, Pd which are of similar construction. The number and configuration of the panels comprising the system may vary from that shown. Each panel, as seen in FIGS. 5 and 6, may include front and back side sections 21, 22 respectively. The sections are of like multilateral configuration (e.g., rectangular) and may be formed of thin, lightweight relatively stiff material. The sections are maintained in a spaced, substantially parallel relation by a lightweight spacer piece 23, which may be of a plastic or paper honeycomb construction. Piece 23 is preferably dimensioned relative to sections 21 and 23 so that a peripheral pocket 24 is formed. The pocket 24 in the illustrated embodiment completely surrounds the periphery of spacer piece 23. The depth and width of pocket 24 are such as to frictionally accommodate a plurality of sections 25 forming a support member K, see FIG. 6. If desired, the sections 25 may be adhesively secured within pocket 24. The number of sections forming the support member K, normally corresponds to the number of sides forming the periphery of the panel. Each support member section is preferably extruded from a lightweight durable metal or plastic material. The ends of each member section 25 are normally shaped so as to form a miter joint. The ends of adjacent support member sections 25 forming a miter joint are interconnected by an angle connecting piece 26, see FIGS. 11–13, as will be described more fully hereinafter.

A support member section 25, as seen more clearly in cross-section in FIG. 6, includes an inner portion 25*a* which is fixedly disposed within the adjacent segment of the peripheral pocket 24 formed in the panel. Integral with the inner portion 25*a* and protruding outwardly from the panel pocket 24 is an outer portion 25*b*. The outer portion 25*b* preferably has an exposed concave (e.g. semi-cylindrical) surface configuration. The juncture J, between the inner and outer portions, is set in, or recessed, from the lateral side edges of the outer portion so that supplemental pockets 27 are formed which accommodate the adjacent peripheral edges of the front or back side section 21 or 22 of the panel, see FIG. 6. Thus, the lateral sides of the outer portion 25*b* overlap a small part of the exposed surface of the accommodated front and back sides 21, 22 of the panel. The overlapping arrangement between the lateral side edges and the front or back side serves a dual function: (a) it provides a finished look to the panel, and (b) it enables the interconnected adjacent panels to assume any selected relative angular position. The exposed surface of the outer portion of the support member K serves also as a backing or support for either a first or second attaching element 28 or 30, respectively. Which attaching element is supported by the support member outer portions will depend upon the location of the support member section on the panel periphery. The first and second attaching elements are of a non-adhesive material, (e.g. Velcro ®) wherein the attaching elements are compatible and interlock with one another only when the elements are initially pressed together. No fasteners, clips or clamps are required to maintain the panels in an interconnected relation, nor is a tool required to press together the compatible attaching elements of the adjoining panels.

As seen in FIGS. 2–4, the first attaching element 28 is located along the top and left side of the panel and the second attaching element 30 is located along the bottom and right side of the panel. If desired, the location or pattern of the first and second attaching elements may vary from that shown. For example, one half the lengths of the left and right peripheral sides of the panel may be provided with the first attaching element and the other half provided with the second attaching element. Thus, when adjoining panels Pa-Pb, Pb-Pc; or Pc-Pd are to be interconnected in a side by side relation (FIG. 1), the first attaching element 28 of one panel contacts and interlocks with the compatible second attaching element 30 of the other adjoining panel. No interconnection will occur between adjoining panels, if like, non-compatible, attaching elements of the two panels are engaging one another. In some installations, it may be desirable to have some of the panels arranged in vertically stacked relation in which case, the attaching elements located along the top and bottom of such panels would interlock with one another.

Because the attaching elements are mounted on the exterior rounded protruding surfaces of the outer portions 25*b* of the support member-sections 25, the interlocked compatible attaching elements of adjoining panels remain in a securely interlocked relation even though one of the adjoining panels is adjusted relative to the other panel to a selected position within an arc of approximately 360°. In order for each panel to have an esthetic appeal, it is preferred that the attaching elements have a color which matches, or is coordinated with the color of the exposed surface of the front side 21 of the panel. As seen in FIG. 5, it may be desirable in some instances, to laminate a decorative fabric or paper onto the exposed surface of the panel front side and/or back side. When the lamina is a fabric, it may have a surface texture which is compatible with one of the attaching elements provided on the other panels of the system and thus, two panels may be interconnected in a T-formation as seen in FIG. 1*c*.

The structural designs which might be created with the four panels of the system 20 varies over a wide range. FIGS. 1, 1*a*, 1*b* and 1*c* show but a few examples of these structural designs. FIG. 1 shows the four panels arranged in an upright side to side relation and forming a boothlike partition or wall I. Such partitions or walls are widely used in display booths at trade shows and the like.

FIG. 1*a* shows the four panels arranged in a cross-like configuration II with one upright side edge of each panel being interconnected so as to provide a vertical axis V. In configuration II the one upright side edge of panel Pa, Pc would be provided with the first attaching element and the one upright side edge of panel Pb, Pd would be provided with the compatible second attaching element. The structural design II is particularly suitable for use as an aisle display in a retail store and the like, where posters, pictures and advertising literature may be mounted thereon.

As shown in FIG. 1*b*, the four panels Pa, Pb, Pc and Pd have been interconnected so as to form an upright column III. Depending upon the height of the structure III, a table top 31, shown in phantom lines, may be centrally positioned over the top of the column III. Thus, in such a structure the column III functions as a table support. In addition, column III alone may be used in schools and libraries for posting bulletins, notices, messages, etc.

The use of such structural designs will vary and depend upon the desire of user. In FIG. 7 the panels are shown in an inoperative mode and disposed within a lightweight carrying case C. The carrying case may be of molded plastic or of a pliable fabric or web of plastic. The case C may include one or more handles H which facilitate manual transportation thereof. Prior to positioning the panels in the carrying case, they are arranged in stacked, face to face, or superposed, relation, see FIG. 8. It is preferred, when stacking the panels, that the non-compatible attaching elements of the panels be in contacting relations. Once the cased panels have been transported to a designated area, they may be readily removed individually from the case and setup to form the desired structural design. As previously mentioned, the panels may be readily interconnected by initially pressing the first attaching element of one panel against the second attaching element of a second panel, see FIG. 9, or against a compatible surface of the second panel, see FIG. 1*c*. When the structural design is to be disassembled, the adjoining interconnected panels are manually pulled apart, as shown in FIG. 10.

The connector piece 26, as seen in FIGS. 11–13 is preferably of unitary construction. The cross-sectional configuration of the piece 26 is such that it will snugly fit into the interior openings F formed in the support member sections which coact to form a miter joint at the peripheral corners of the panel. The piece 26 as seen in FIG. 12 has an enlarged side edge 26*a* which subtends and supports the outer portion 25*b* of the support member section, when the corner piece is assembled therewith. The opposite edge 26*b* of the piece 26 engages the inner bail segment 25*c* of the inner portion 25*a* of the support member section.

As aforenoted the improved portable partition system is intended for use at trade-shows, conventions, retail stores, schools, libraries and the like for display and marketing purposes, it may also be utilized as an educational toy for children. In such cases, however, the scale as well as the weight of the various components are significantly reduced. In addition the peripheral shapes of the various components may vary over a wide range, as seen for example in FIGS. 14–17. The component or panel 31 in FIG. 14 may have a square configuration, and the cent r portion 31*a* thereof may be a single piece of plastic, composition board or the like. The center portion 31*a* may be transparent, translucent or opaque and may be of one or more colors. The periphery of the center portion may be encompassed by first and second attaching elements 31*b* and 31*c* arranged in end to end relation.

FIG. 15 shows a component 32 having an equal lateral triangular peripheral configuration. Two of the three peripheral sides may have a first attaching element 32*a* mounted thereon and the remaining side may have a second attaching element 32*b* mounted thereon.

Component 33, as seen in FIG. 16 may have an octagonal configuration with alternate sides having either first or second attaching elements 33*a*, 33*b* , respectively, mounted thereon.

In FIG. 17, a component 34 is shown which has an isosceles triangular configuration. In this construction, a first attaching element 34*a* may be mounted on one of the equal sides and one half of the hypotenuse and a second attaching element 34*b* on the remaining peripheral portions.

The component may take other geometric forms not shown. Thus, with the smaller, toylike components, the child not only learns to identify various geometric forms, but also improves his or her fine motor skills by handling and manipulating the various components. Because of simplicity of construction, the connecting and disconnecting of components can be readily performed with a minimum amount of manual effort.

When the components are in an inoperative mode they may be readily stacked in face to face relation and easily manually carried from place to place. The components may be expeditiously setup and dismantled without the need for any tools or the services of a skilled mechanic. The components are of simple, inexpensive, yet, sturdy construction and may be utilized for many different functions.

I claim:

1. A portable partition system comprising only a plurality of planar, substantially inflexible, independent, lightweight, self-contained display panel components adapted to assume either an operative or inoperative mode, at least one panel component having a multilateral peripheral configuration including spaced substantially parallel front and back sides having corresponding upright peripheral segments thereof cooperating to form a recessed pocket extending substantially the full height of the panel component, and an elongate support member of one piece construction formed of substantially rigid material, said support member including an inner portion fixedly accommodated within the elongate pocket and substantially occupying same and an outer portion integral with said inner portion and protruding from an open side of said pocket, said outer portion having a substantially convex exterior surface on which is mounted a first attaching means, said outer portion and first attaching means extending substantially the full length and width of the pocket; a second panel component having an elongate exterior surface portion on which is mounted a second attaching means; when in an operative mode, said one panel component assuming an upright abutting relation with said second panel component whereby the first attaching means thereof is pressed against the second attaching means of the second panel component effecting a frictional interconnection therebetween, said abutting panel components while interconnected forming an upright partition and being adapted to assume any selected upright relative angular position, and when in an inoperative mode, said panel components being disconnected and independent of one another and being adapted to assume a compact portable unit wherein the independent panel components are arranged in stacked relation with planar surfaces of the stacked panel components being in proximate, superposed face to face relation.

2. The system of claim 1 wherein the second attaching means is disposed on a planar surface of the second panel component; when said components are in the operative mode, one of the attaching means providing a fulcrum about which said panel components are adapted to pivot to the selected relative angular position.

3. A portable partition system comprising at least a pair of adjacent display panel components each being of lightweight construction and adapted to assume either an operative or inoperative mode; when in an operative mode, said adjacent panel components forming an upright partition and having upright peripheral segments thereof in abutting frictionally interconnected relation whereby said panel components are adapted to assume any selected upright angular relative positions, and when in an inoperative mode, said adjacent panel components being disconnected and adapted to assume a compact portable unit wherein the disconnected panel components are independent of one another and arranged in stacked face to face relation; each panel component including a planar substantially inflexible center section having a pair of opposed upright inflexible peripheral segments, one segment being provided with an exposed first attaching means extending the full length and width thereof and the other segment being provided with an exposed second attaching means extending the full length and width thereof; when the adjacent panel components are in the operative mode, the first attaching means of one adjacent panel component frictionally interconnects with the second attaching means of the other adjacent panel component, said interconnection extending substantially the full height of the formed upright partition.

4. The system of claim 3 wherein each panel component includes a multilateral center section with inflexible second peripheral segments extending angularly from and interconnecting opposite ends of the upright peripheral segments; one upright peripheral segment and one second peripheral segment being provided with only the first attaching means, and the other upright peripheral segment and other second peripheral segment being provided with only the second attaching means.

* * * * *